US006983875B2

(12) United States Patent
Emmott

(10) Patent No.: US 6,983,875 B2
(45) Date of Patent: Jan. 10, 2006

(54) APPARATUS FOR FASTENING AND SEPARATING CONTAINERS

(76) Inventor: Gary Emmott, 1114 Nantucket, Unit E, Houston, TX (US) 77057

( * ) Notice: Subject to any disclaimer, the term of this patent is extended or adjusted under 35 U.S.C. 154(b) by 0 days.

(21) Appl. No.: 10/784,504

(22) Filed: Feb. 23, 2004

(65) Prior Publication Data

US 2004/0164137 A1 Aug. 26, 2004

Related U.S. Application Data

(60) Provisional application No. 60/450,056, filed on Feb. 25, 2003.

(51) Int. Cl.
*B65D 27/34* (2006.01)

(52) U.S. Cl. ..... 229/313; 229/80; 229/87.05

(58) Field of Classification Search ..... 229/313–314, 229/87.05, 301–305, 80–81, 237, 206, 208, 229/243–244, 200, 210
See application file for complete search history.

(56) References Cited

U.S. PATENT DOCUMENTS

| | | | | |
|---|---|---|---|---|
| 190,630 | A | 5/1877 | Simonson | |
| 443,611 | A | 12/1890 | Dubey | |
| 576,552 | A | 2/1897 | Cook | |
| 579,467 | A | 3/1897 | Brevard | |
| 638,561 | A | 12/1899 | Cook | |
| 811,092 | A | 1/1906 | Roberts | |
| 1,065,012 | A | 6/1913 | Watanabe | |
| 1,073,056 | A * | 9/1913 | McFarlane | 229/80 |
| 1,106,721 | A | 8/1914 | Lewis | |
| 1,791,352 | A | 2/1931 | Colonnese | |
| 1,963,639 | A | 6/1934 | Ahlquist | |
| 2,001,340 | A | 5/1935 | Bear et al. | |
| 2,083,158 | A | 6/1937 | Ramsey | |
| 2,128,196 | A | 8/1938 | Vogel | |
| 2,129,705 | A * | 9/1938 | Reineman | 229/81 |
| 2,131,575 | A | 9/1938 | Whipple | |
| 2,330,666 | A | 9/1943 | Berkowitz | |
| 2,363,957 | A | 11/1944 | Goff | |
| 2,476,740 | A * | 7/1949 | Krall | 229/80 |
| 2,535,537 | A | 12/1950 | Heywood | |
| 2,828,060 | A * | 3/1958 | Brown | 229/208 |
| 3,298,595 | A | 1/1967 | Collura | |
| 3,423,005 | A * | 1/1969 | Leibson et al. | 229/228 |
| 3,512,702 | A | 5/1970 | Pritchard | |
| 3,900,642 | A | 8/1975 | Michel | |
| 4,166,538 | A | 9/1979 | Nixon et al. | |
| 4,192,448 | A | 3/1980 | Porth | |
| 4,436,206 | A | 3/1984 | Kuchenbecker | |
| 4,548,318 | A * | 10/1985 | Boyle | 229/221 |
| 4,566,627 | A | 1/1986 | Gendron | |
| 4,746,052 | A | 5/1988 | Schmissrauter | |

FOREIGN PATENT DOCUMENTS

| | | | |
|---|---|---|---|
| GB | 12386 | * | 7/1894 |

* cited by examiner

*Primary Examiner*—Jes F. Pascua
(74) *Attorney, Agent, or Firm*—E. Randall Smith

(57) ABSTRACT

An apparatus for fastening together at least first and second container portions and allowing the separation thereof includes at least one adhesive spot disposed upon at least one among the first and second container portions. The at least one adhesive spot is capable of fastening together the first and second container portions. One or more weakened area is located on at least one of the container portions and assists in easing the separation and release of the container portions.

22 Claims, 10 Drawing Sheets

20
30
32
32a
32b
32c
34
36

APPARATUS FOR FASTENING AND SEPARATING CONTAINERS

This application claims the benefit of U.S. Provisional Patent Application Ser. No. 60/450,056 filed Feb. 25, 2003 and entitled Connecting and/or Separating Mechanism.

BACKGROUND OF THE INVENTION

The invention relates to apparatus, articles of manufacture and methods relating to fastening and separating container portions.

Many containers, such as envelopes, re-usable envelopes, pockets, carriers, cartons, boxes, folded forms, greeting cards, packaging, brochures, booklets, magazines and mailers, are designed to be sealed or fastened and thereafter opened or separated. Various problems and inefficiencies are associated with the sealing and subsequent opening of containers. For example, unsealing or opening of the item is often difficult, messy or damaging to the item. Attempts at solving the problems and inefficiencies associated with fastening and separating such items have proven unsatisfactory.

Accordingly, there exists a need for apparatus, methods and articles of manufacture for fastening and separating containers having one or more of the following attributes, capabilities or features: allows for easy release, separation or opening of connected container portions; limits, minimizes or eliminates damage to container portions being separated; reduces, limits, eliminates or controls tearing of container portions during separation; reduces, limits, eliminates or controls tearing of container portions during separation regardless of the direction of separation of the connected container portions; reduces, limits, eliminates or controls tearing of container portions during separation when the connected container portions are separated in a particular direction; indicates tampering or attempted opening of connected container portions; prevents or reduces damage to text or graphics included on one or more connected/separated container portion provides an intuitive mechanism for opening or separating connected container portions; makes opening containers easier; provides simple, dependable, easy-open functionality for containers; preserves the appearance and/or integrity of connected container portions after separation; provides desired sturdiness of affixation/separation mechanisms; eliminates the need for equipment to open certain containers or separate connected container portions; enables re-use, resealing or remailing of containers; prevents accidental opening of perforations on containers; allows for easy connection of container portions; removes or reduces uncertainty in determining the quantity and extent of affixation material to include on container portions to be connected; enables the manufacture, sealing and use of containers with less affixation material; simplifies the manufacturing process of containers; removes or reduces potential difficulties in processing and/or handling containers; allows for easy use of container manufacturing and handling equipment, such as high-speed envelope insertion and sealing equipment.

BRIEF SUMMARY OF THE INVENTION

Various embodiments of the present invention involve apparatus and methods for fastening together at least two container portions of at least one among an envelope, mailer, form and brochure and allowing the separation thereof. In some embodiments, at least one adhesive spot is disposed upon the first container portion. The at least one adhesive spot is capable of fastening together the first and second container portions. At least one weakened area is formed into the first container portion. Each weakened area is disposed adjacent to an adhesive spot, includes at least three cuts and has an overall generally arcuate shape. The at least one weakened area assists in easing the separation and release of the first and second container portions by limiting the tearing of at least one container portion proximate to the adhesive spot(s). The at least one weakened area is sturdy enough to limit detachment of the first container portion proximate to the at least one adhesive spot from the first container portion.

In various embodiments, the at least one adhesive spot is alone capable of fastening together the first and second container portions absent any other adhering mechanism for fastening together the first and second container portions. A first the adhesive spot is disposed upon the first container portion, and at least one pair of weakened areas is included. Each weakened area includes at least two cuts. A first the pair of weakened areas includes a first weakened area disposed adjacent to the first adhesive spot on the first container portion and a second weakened area disposed on the second container portion in alignment with the first weakened area. When the first and second container portions are connected together, one of the first and second weakened areas overlays the other weakened area. The weakened areas assist in easing the separation and release of the first and second container portions by limiting the tearing of the container portions proximate to the adhesive spot(s) without the detachment of a substantial part of either container portion proximate to the adhesive spot(s) during separation thereof.

In some embodiments, at least one adhesive spot is disposed upon the first container portion, and at least one weakened area is disposed adjacent to each adhesive spot. The at least one weakened area includes a plurality of cuts. At least one of the plurality of cuts of at least one of the weakened areas at least partially overlaps at least one other cut. The weakened area assists in easing the separation of the first and second container portions by limiting the tearing of at least one of the container portions proximate to the adhesive spot(s) without detachment of a substantial part of either container portion proximate to the adhesive spot(s) during separation thereof.

In certain embodiments, the present invention involves an apparatus for sealing together at least two container portions of at least one container and allowing the separation thereof. First and second engageable container portions are included. At least one among the first and second container portions is removable from the container(s), which may thereafter be resealed. At least one adhesive spot is disposed upon at least one among the first and second container portions and capable of fastening them together. At least one weakened area is disposed adjacent to an adhesive spot. The at least one weakened area assists in easing the separation of the first and second container portions by limiting the ply separation of at least one container portion proximate to the at least one adhesive spot without detachment of a substantial part of either container portion proximate to the at least one adhesive spot during separation thereof.

The present invention also includes embodiments of an apparatus for fastening together at least two container portions and allowing the separation thereof. First and second engageable container portions are included. At least one adhesive spot is disposed upon at least one among the first and second container portions. The at least one adhesive spot is alone capable of fastening together the first and second container portions absent any other adhesive for fastening them together. A first adhesive spot is disposed upon the first container portion. At least one pair of weakened areas is also included. Each weakened area includes a plurality of cuts. At least one of the plurality of cuts of at least one weakened area at least partially overlaps at least one other cut. The first pair of weakened areas includes a first weakened area disposed adjacent to the first adhesive spot on the first container portion and a second weakened area disposed on the second container portion in alignment with the first weakened area. When the first and second container portions are connected together, one of them overlays the other. The weakened areas assist in easing the separation and release of the first and second container portions by limiting the tearing of the container portion proximate to the adhesive spot(s) without detachment of a substantial part of either container portion proximate to the adhesive spot(s) during separation thereof.

Accordingly, the present invention includes features and advantages which are believed to enable it to advance container connecting and/or separation technology. Characteristics and advantages of the present invention described above and additional features and benefits will be readily apparent to those skilled in the art upon consideration of the following detailed description of preferred embodiments and referring to the accompanying drawings.

BRIEF DESCRIPTION OF THE DRAWINGS

For a detailed description of preferred embodiments of the invention, reference will now be made to the accompanying drawings wherein.

DETAILED DESCRIPTION OF PREFERRED EMBODIMENTS OF THE INVENTION

Figure 1:
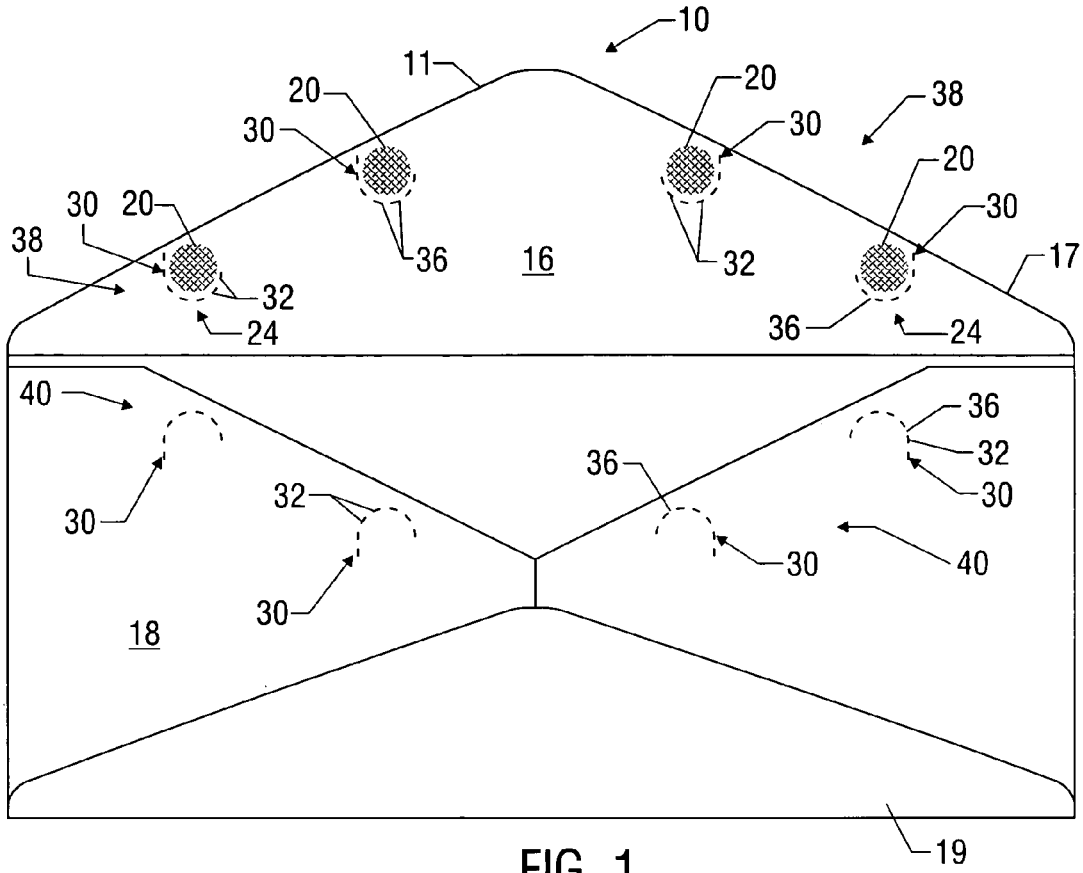
FIG. 1 is a front view of an example envelope-type container having a seal flap and facing panel and including an embodiment of the present invention having multiple adhesive spots and weakened areas.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents, and alternatives falling within the spirit and scope of the invention as defined by the appended claims. In showing and describing the preferred embodiments, common or similar features are indicated by like or identical reference numerals or, in the absence of a reference numeral, are evident based upon the appended drawings and/or description herein. The figures are not necessarily to scale and certain features and certain views of the figures may be shown exaggerated in scale or in schematic in the interest of clarity and conciseness.

As used in this patent (including the headings) of this patent, the terms "invention", "present invention" and variations thereof are not intended to mean the invention of every possible embodiment of the invention or any particular patent claim or claims. Thus, the subject or topic of each such reference is not necessarily part of every embodiment of the invention or required by any particular claim(s) merely because of such reference.

Figure 2:
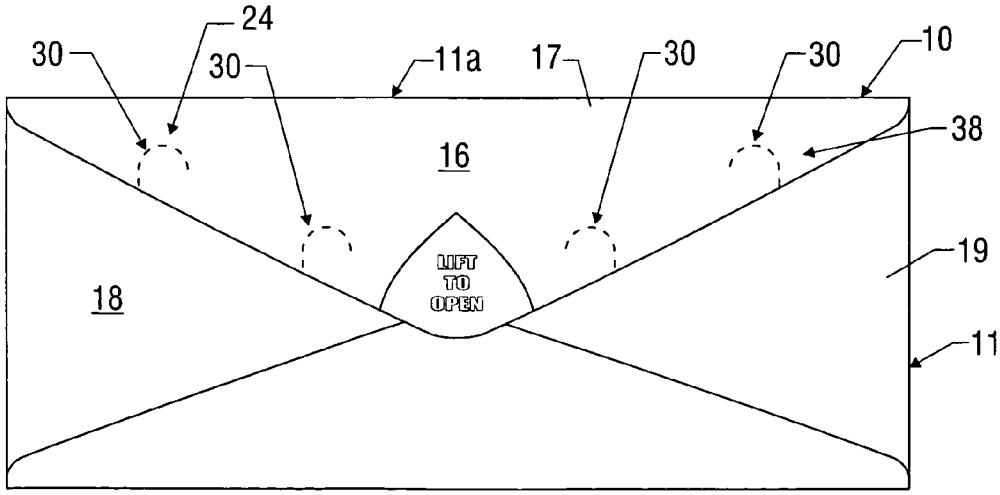
FIG. 2 shows the container shown in FIG. 1 having its seal flap and facing panel engaged together.

Referring initially to the embodiment of FIGS. 1–2, the present invention includes at least one adhesive spot 20 and at least one weakened area 30 on a container 10. The use of various terms herein (such as "adhesive spot", "weakened area") in the singular grammatical form means "one or more" unless specifically indicated otherwise. In the illustrated example, the adhesive spot 20 and weakened area 30 are used in connection with the fastening and subsequent separation or release of first and second portions 16, 18 of the container 10. It should be noted that the adhesive spot 20 and weakened area 30 of the present invention may be used in connection with the fastening and subsequent release of any two or more portions of the same container or multiple containers.

In accordance with one independent aspect of the present invention, the adhesive spot 20 is used to adhere the subject container portions together to attach or connect them, or to seal, close, enclose, fasten or secure the container, a part of the container or multiple containers. It should be understood that the present invention is in no way limited by the purpose for the connection or fastening, or the nature of the container(s) or connected container portions or the item or area that is enclosed. The adhesive spot 20 does not span the entire length or width of the container portion upon which it is disposed. In some applications, the adhesive spot 20 may be formed of a minimal or particular size, such as to provide sufficient bonding and tension to connect the subject container portions, while having a desirable release factor to enable controlled separation thereof. Further, as desired, the adhesive spot 20 may or may not be used in addition to one or more other mechanism for adhering or connecting the subject container portions.

The adhesive spot 20 may be any desired, suitable mechanism for adhering the desired container portions together. For some examples, the adhesive spots 20 may be constructed of glue, tape, adhesive, remoistenable gum or glue, contact gum or glue, latex gum, peel-n-seal tape, two-sided taps, fugitive adhesive and any combination thereof. Thus, as used in this patent, the term "adhesive spot" means any suitable mechanism disposed upon and spanning less than the entire length or width of at least one container portion for adhering two or more container portions together.

The adhesive spot 20 may have any suitable shape, size and orientation. Also, if desired, the type, quantity and thickness of the adhesive spot 20 may be selected, such as to provide sufficient bonding and tension while having a desirable release factor to enable controlled separation of the connected container portions. In the embodiment of FIG. 1, for example, each adhesive spot 20 is constructed of mailing glue formed in a generally circular shape with a standard thickness for use on paper envelopes. Some examples of other possible shapes of adhesive spots 20 are shown in FIGS. 3A–C, 4A–B. In yet other examples, the adhesive spot 20 may be elongated in any direction (not shown). Further, when multiple adhesive spots 20 are included, the spots 20 may differ in any desired manner, such as in shape, size, orientation and/or thickness.

In another independent aspect of the present invention, the weakened area 30 assists in (i) easing the separation or release of the connected container portions, (ii) reducing damage to, tearing or detachment of, the connected container portions during separation, (iii) preventing destruction of printed matter and/or graphics on the container, or any combination of (i)–(iii). As used in this patent, the terms "separation control", "easing the separation" and variations thereof means having one or more of the capabilities of (i)–(iii) above. Some examples of separation control (easing the separation) are limiting the tearing, adhesion, peeling or ply separation of at least one of the connected container portions during separation regardless of the direction of separation of the connected container portions, controlling the separation or tearing of the connected container portions without the detachment of the associated adhesive spot from its original container portion and controlling damage to the connected container portions when separated in a particular direction. The present invention can also be used in certain applications to provide evidence of separation, tampering or entry.

In the example of FIG. 1, the container 10 is an envelope 11, the first portion 16 is an envelope seal flap 17 and the second portion 18 is an envelope panel 19 that faces the seal flap 17 when engaged therewith. However, the container may be virtually any item or items of any nature having at least two portions that are desired to be fastened or connected together and separated or disconnected. Moreover, the present invention may be used to connect and disconnect two or more containers. Accordingly, as used in this patent, the term "container" means any single item having two portions that are desired to be fastened or connected and separated or disconnected, or two or more items that are desired to be connected and disconnected. Further, in any application of the invention, the removable and/or non-removable container portions may include any desired printed matter, such as advertisements or coupons (not shown).

Some other examples of containers include carriers, boxes, folded forms, welded forms, greeting cards, packaging, cartons, mailers, pockets, brochures, booklets, magazines, books, as well as re-usable cartons, boxes, forms, packaging, mailers and envelopes. With respect to the use of the present invention with envelopes, any desired type or configuration of envelope may be used. Some example types of envelopes are billing, proxy, direct mail, correspondence, storage and filing envelopes and overnight carriers. The envelopes may, for example, be constructed with a closure seal flap, a front panel and a back panel, and manufactured with or without in-side seam flaps, out-side seam flaps, diagonal seams, V-Flap seams, welded side-seams, multiple part snap-out seams, continuous form welded seams, or any combination thereof, or other suitable configuration. The envelopes may or may not include any desired type of window(s). Existing or conventional envelopes can be retrofitted with the present invention, or the present invention can be used with new or modified envelope designs. When used with envelopes, the present invention is in no way limited by the type or characteristics of the envelope.

Any suitable number of adhesive spots 20 and weakened areas 30 may be used. In the example of FIG. 1, multiple adhesive spots 20 and weakened areas 30 are included. A first group 38 of weakened areas 30 is formed into the envelope seal flap 17 adjacent to a set of adhesive spots 20. A weakened area 30 located adjacent to an adhesive spot 20 on the same container portion is sometimes referred to in this patent as an "adjacent" weakened area. In some applications, such as in FIG. 1, it may be desirable to have an adjacent weakened area 30 as close as feasible (e.g. in consideration of any pertinent production tolerances/limitations) to an adhesive spot 20 to optimize separation control.

The example of FIG. 1 also includes a second group 40 of weakened areas 30 formed into the facing panel 19, which does not have any adhesive spots 20. A weakened area 30 not adjacent to an adhesive spot 20 on the same container portion is sometimes referred to in this patent as an "opposing" weakened area. Each weakened area 30 of the second group 40 of this example has the same configuration and shape as the first group 38 of weakened areas 30. When the first and second portions 16, 18 are connected, the first group 38 of weakened areas 30 aligns with and overlays the second group 40. It should be understood, however, that the present invention does not require the inclusion of both adjacent and opposing weakened areas 30. Some embodiments include only adjacent weakened areas 30, while others include only opposing weakened areas 30. Further, when both types of weakened areas 30 are included, there need not be one opposing weakened area for each adjacent weakened area and vise versa, and the adjacent and opposing weakened areas 30 need not have the same configuration, shape and orientation.

In accordance with another independent aspect of the present invention, the weakened area 30 includes at least one cut 32 formed into the container 10. As used in this patent, the term "cut" means one or more score, perforation, hole, indentation, thin section or any other formation that is weaker than other areas of the container portion upon which it is included, or any combination thereof. In the example of FIG. 1, each illustrated cut 32 is a perforation extending through the respective envelope seal flap 17 and panel 19.

Still referring to the example of FIG. 1, when more than one cut 32 is included in a weakened area 30, a connector or gap 36 extends between adjacent cuts 32. In the embodiment shown, the connector 36 is a space between adjacent cuts 32 where the container portion is generally unaltered. In other embodiments, the connector 36 may include any desired alteration to the container portion.

The cuts 32 and connectors 36 (when included) may have any desired shape, size and orientation. For example, the shape and size of the cuts and connectors may be selected based upon the material composition, thickness of the container and/or the desired separation control and sturdiness (as defined below). In typical applications, the cuts 32 assist in limiting or stopping tearing of or damage to one or more connected container portion during separation, thus enhancing release of the container portions and separation control. In contrast, in typical applications, the connectors 36 serve a different purpose—to provide support and sturdiness to the weakened area 30 during handling of the container and/or during separation. This feature is sometimes referred to herein as "sturdiness". Some examples of sturdiness are to prevent inadvertent or undesirable breaking of the cuts 32 prior to separation of the connected container portions, and/or to withstand separating tension and prevent undesired detachment of the corresponding adhesive spot 20 and attached material from its original container portion during separation. At the same time, however, the connectors 36 (in such applications) essentially act against separation control by serving as potential paths ("tear paths") for undesirable tearing and damage to one or more of the connected container portion(s) during separation thereof. Accordingly, in various applications, the longer the cut(s) 32, the greater the separation control and the less sturdy the weakened area 30, while the longer the connectors 36, the less the separation control and greater the sturdiness. Thus, it may be desirable or necessary to consider the above factors in determining the nature and configuration of the weakened area 30 in any particular application.

Figure 3A:
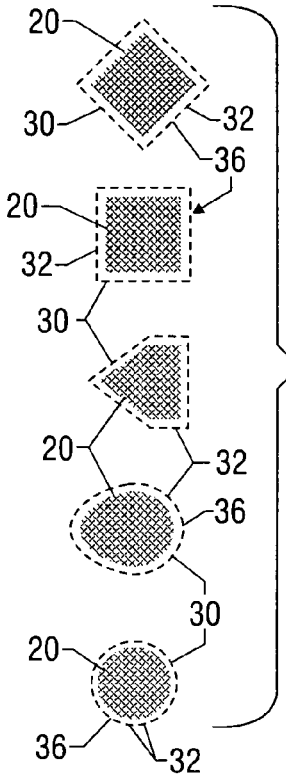
FIG. 3A–3C are isolated views of various embodiments of adhesive spots with weakened areas having short cuts in accordance with the present invention.
Figure 4A:
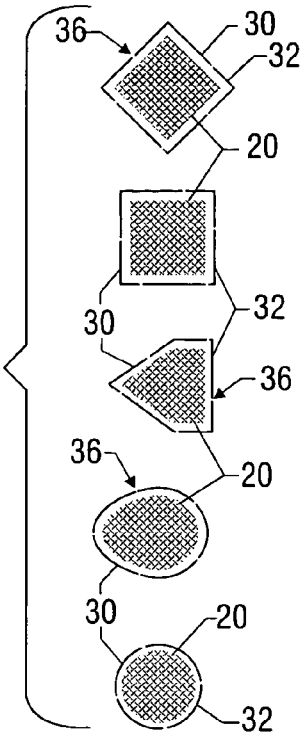
FIG. 4A–B are isolated views of various embodiments of adhesive spots with weakened areas having long cuts in accordance with the present invention.
Figure 3B:
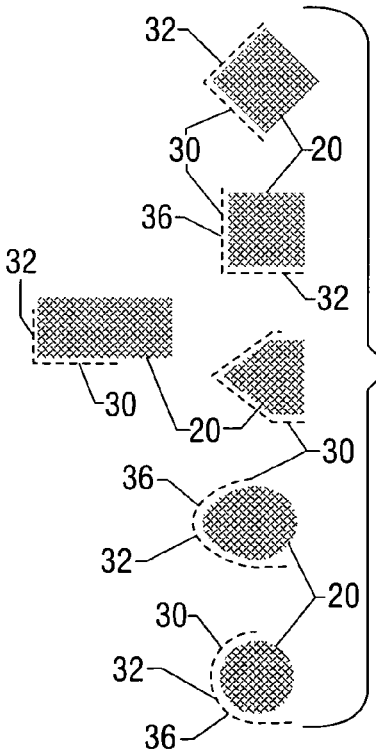
Figure 3C:
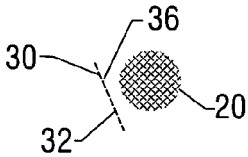
Figure 4B:
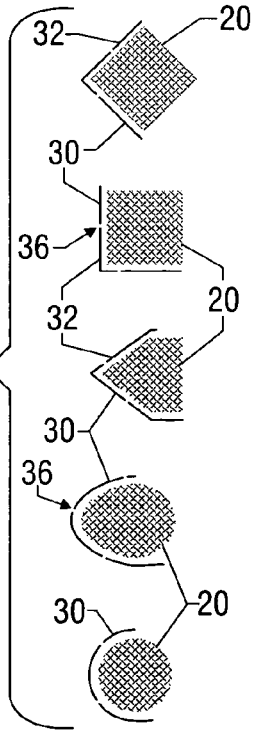

In the embodiments of FIGS. 3A–C, the weakened areas 30 each include a large number of short perforation-type cuts 32 and short connectors 36. In the examples of FIG. 4A–B, the weakened areas 30 each include a small number of long cuts 32 and only a few short connectors 36. While the weakened areas 30 of FIG. 4A–B may provide greater separation control in some applications as compared to the weakened areas 30 of FIGS. 3A–C, they may also be less sturdy.

In another independent aspect of the invention, the cut(s) 32 and connectors 36 (when included) of each weakened area 30 may be formed in any desired pattern, configuration and location. In FIG. 1, each adjacent weakened area 30 includes a single line of multiple short cuts 32 and corresponding short connectors 36 formed in a generally arcuate pattern adjacent to and around part of the perimeter of the corresponding adhesive spot 20. Some other example configurations of cuts 32 and connectors 36 forming weakened areas 30 are shown in FIGS. 3A–C and 4A–B.

In other embodiments, such as the examples of FIGS. 5A–F, the weakened area(s) 30 may include one or more overlapping cut 34. An overlapping cut 34 is a cut 32 that at least partially overlaps at least one other cut 32 (which may also be an overlapping cut 34) of the weakened area 30 without crossing such other cut(s) 32. As used in this patent, the term "overlap" and variations thereof means to be in front of or behind relative to an adhesive spot, or adjacent to, such as parallel, and not crossing. The use of overlapping cuts 34 in the weakened area 30 may, in various applications, improve or provide desired separation control and sturdiness. For example, in the embodiment of FIG. 5F, the weakened area 30 can be configured so that at least some of the connectors 36*a* are not facing, or are sideways relative to, the adhesive spot 20, while other connectors 36*b* are blocked by the overlapping cuts 34, lessening the likelihood of the connectors 36 serving as actual tear paths during separation. In such instance, the overlapping cuts 34 convolute the tear paths formed by the connectors 36. However, the present invention does not require either non-facing connectors 36*a* and/or blocked connectors 36*b* for all weakened areas 30 with overlapping cuts 34.

Any desired number of overlapping cuts 34 may be included in any desired configuration. Further, the overlapping cuts 34 may have any desired shape. For example, FIGS. 5A–F show various embodiments of arcuate-shaped cuts 32*a*, linear cuts 32*b* and combination arc/linear cuts 32*c*. Further, the weakened area 30 may include all of the same type of overlapping cut 34 or any combination of different types of overlapping and/or non-overlapping cuts.

Figures 5A, 5B, 5C, 5D, 5E, 5F:
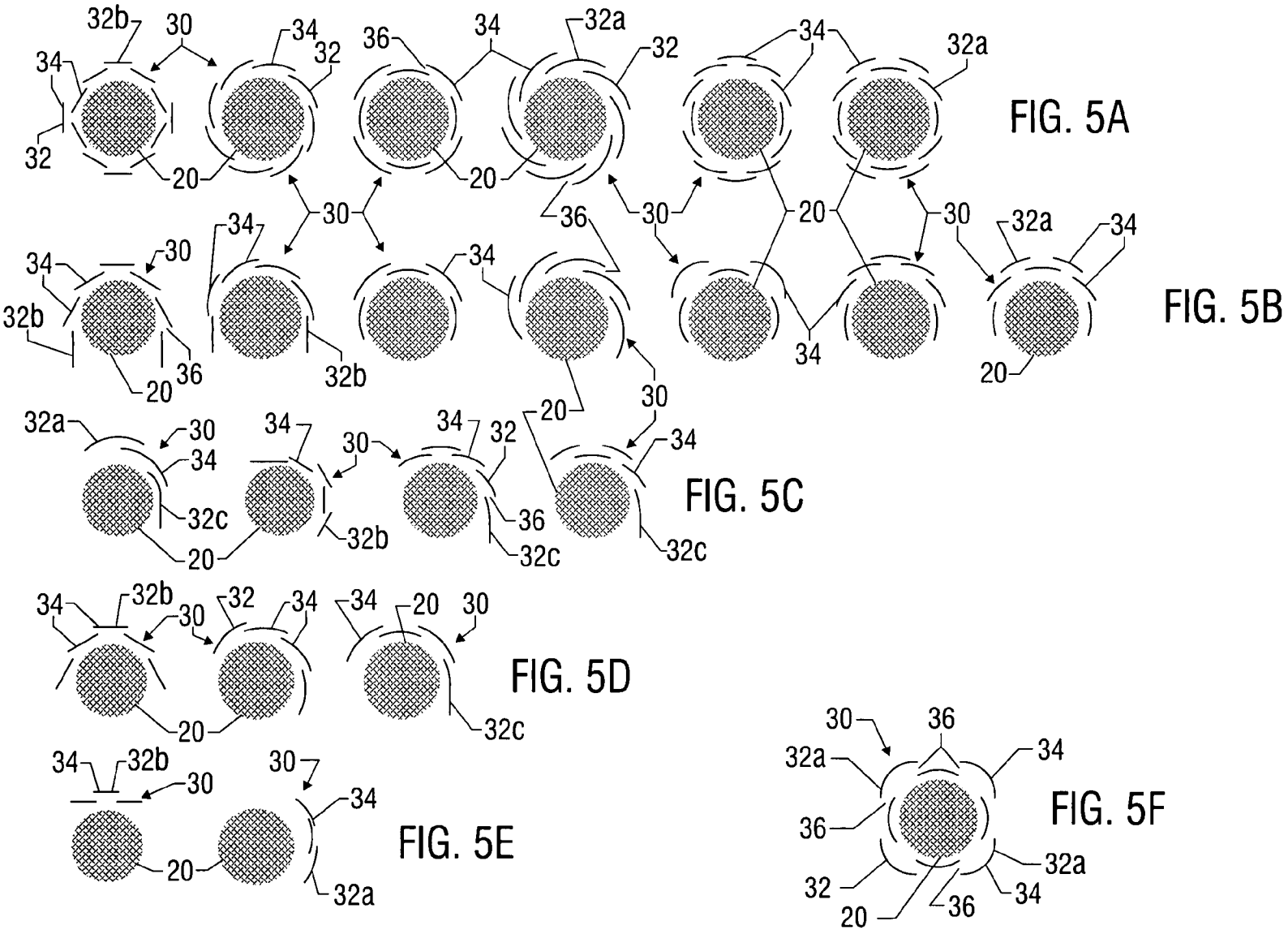
FIG. 5A–F are isolated views of various embodiments of adhesive spots with weakened areas having overlapping cuts in accordance with the present invention.

The overlapping cuts 34, when included, may have any desired length. In some applications, long cuts 34 and/or long connectors 36 may provide sufficient sturdiness and still provide desired separation control. In the embodiment of FIG. 5F, for example, the weakened area 30 includes large overlapping cuts 34 and large connectors 36. Because the overlapping cuts 34 cumulatively entirely surround the perimeter of the adhesive spot 20, the weakened area 30 should be expected (in various applications) to terminate virtually all container portion tearing and damage around the corresponding adhesive spot 20 during normal separation. At the same time, the connectors 36 should provide suitable sturdiness to withstand separating tension and prevent substantial or in some cases any, detachment of material from either or both container portions proximate to the corresponding adhesive spot.

In still a further independent aspect of the present invention, the cuts 32 and connectors 36 of a weakened area 30 may be disposed in any desired orientation relative to one or more adhesive spot 20. FIGS. 3A–5F show a multitude of different example orientations. In the embodiments of FIGS. 3C and 5E, the cuts 32 are located generally adjacent to one side of the adhesive spot 20. In the embodiments of FIG. 5C, the cuts 32 are located generally adjacent to two sides of the adhesive spot 20. In the embodiments of FIG. 5B, the cuts 32 are located generally adjacent to three sides of the adhesive spot 20. In the embodiment of FIGS. 3A, 4A, 5A and 5F, the cuts 32 generally surround the adhesive spot 20. In many applications, a weakened area 30 having surrounding cuts 32, such as the embodiments of FIG. 5A with its overlapping cuts 34, may be designed to provide optimal separation control and optimal sturdiness by preventing undesired tearing, while withstanding separating tension to avoid adhesive spot detachment. In other applications, a weakened area 30 with surrounding cuts 32, such as shown in FIG. 4A, may be designed to provide for detachment of part of the connected container portion originally having the adhesive spot (see e.g. FIG. 17B).

The orientation or positioning of the cuts 32 forming a weakened area 30 may, if desired, be selected based upon the expected or proscribed direction(s) of separation of the connected container portions, or to provide separation control regardless of the direction of separation. For example, in the embodiment of FIGS. 1 and 2, the cuts 32 of the weakened areas 30 are located around the trailing side 24 of the adhesive spots 20. The trailing side 24 is the last side of the adhesive spot 20 to be disconnected during separation. In FIG. 2, the expected or proscribed direction of separation of the first and second portions 16, 18 is the lifting of the envelope seal flap 17 upwardly from the facing panel 19 and toward the top 11*a* of the envelope 11. If that occurs, each weakened area 30 will provide separation control relative to its corresponding adhesive spot 20.

For other examples, the cuts 32 of the embodiments of FIGS. 3C and 5E can be positioned on the expected trailing side of the corresponding adhesive spot 20. The cuts 32 of the embodiment of FIG. 5C will provide separation control when the connected container portions are separated generally in either of two directions. In the embodiments of FIG. 5B, the cuts 32 will provide separation control when the connected container portions are separated generally in any of three directions. For yet other examples, weakened areas 30 having cuts 32 that generally or substantially entirely surround an adhesive spot 20, such as in FIGS. 3A, 4A, 5A and 5E, may be included to provide separation control regardless of the proscribed direction of separation of the connected container portions.

Figure 6:
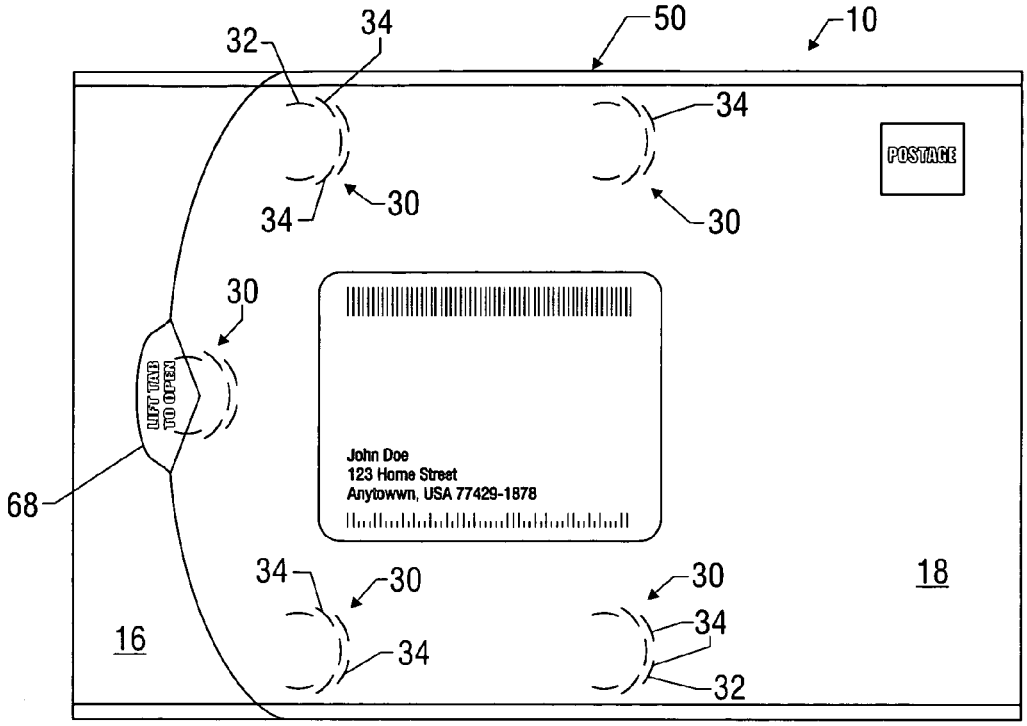
FIG. 6 is a front view of an example disc-holding container including an embodiment of the present invention having weakened areas with overlapping cuts.

Referring to the embodiment of FIG. 6, the present invention is shown used on an example DVD/CD mailer 50 having first and second portions 16, 18. A plurality of weakened areas 30 with overlapping cuts 34 is formed in the second portion 18 adjacent to numerous adhesive spots (not shown). The proscribed direction of separation of the first and second portions 16, 18 is from left to right and the cuts 34 of the weakened areas 30 encompass the trailing sides 24 of the adhesive spots 20.

Figure 7A:
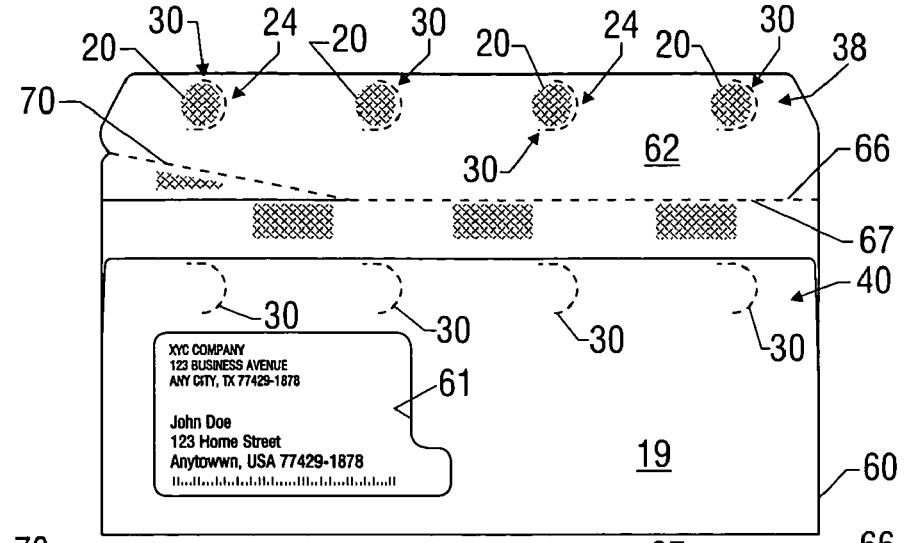
FIGS. 7A–C are front views of an example reusable envelope-type container including an embodiment of the present invention.
Figure 7B:
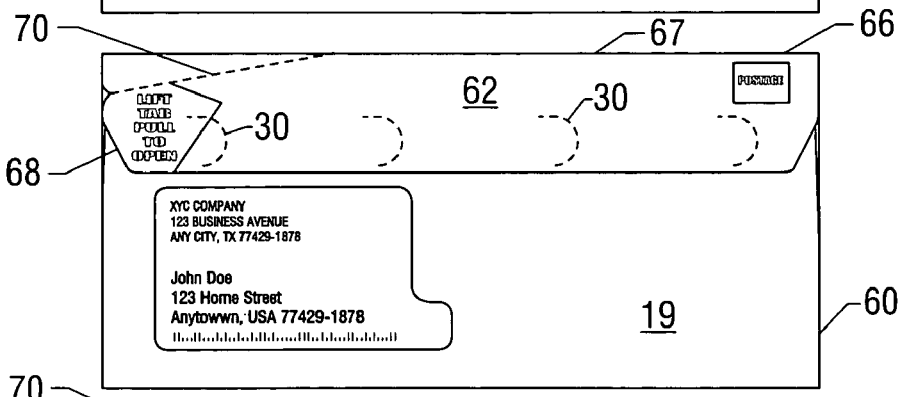
Figure 7C:
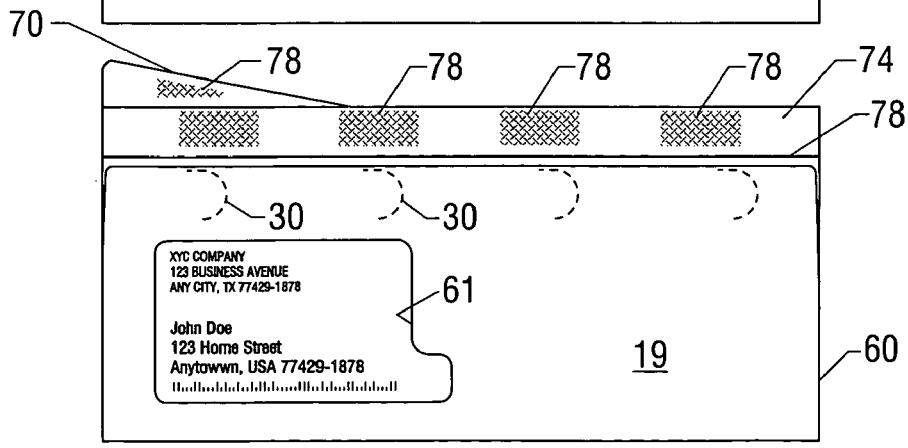
Figure 7D:
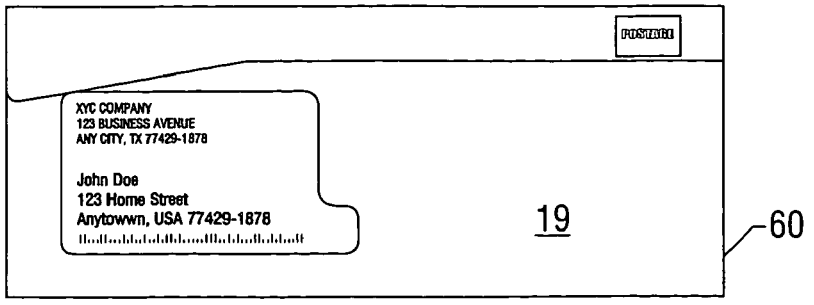

FIGS. 7A–D show an embodiment of the present invention used in connection with an example reusable envelope 60 having an address window 61. As shown in FIG. 7A, a first group 38 of weakened areas 30 and adjacent adhesive spots 20 is included on an initial seal flap 62. A second group 40 of weakened areas 30 is included on the facing panel 19. FIG. 7B shows the initial seal flap 62 folded down along top fold line 66 and engaged with the facing panel 19 by the adhesive spots 20. To open the envelope 60 and preserve it for reuse (e.g. resealing, remailing), the initial seal flap 62 is gripped and lifted, such as at a tab 68, and preferably pulled to the right. In this example, the initial seal flap 62 will separate from the envelope 60 along an angled perforation line 70 and a perforated part 67 of the top fold line 66. At substantially the same time, the first and second sets 38, 40 of weakened areas 30 provide separation control at the adhesive spots 20, allowing the initial seal flap 62 to be generally concurrently separated from the facing panel 19 and detached from the envelope 60. After the initial seal flap 62 is removed, as shown in FIG. 7C–D, a re-seal flap 74 may be folded along a second fold line 78 and engaged with the facing panel 19, such as by the adhesive areas 78, for reuse of the envelope 60.

Figure 8:
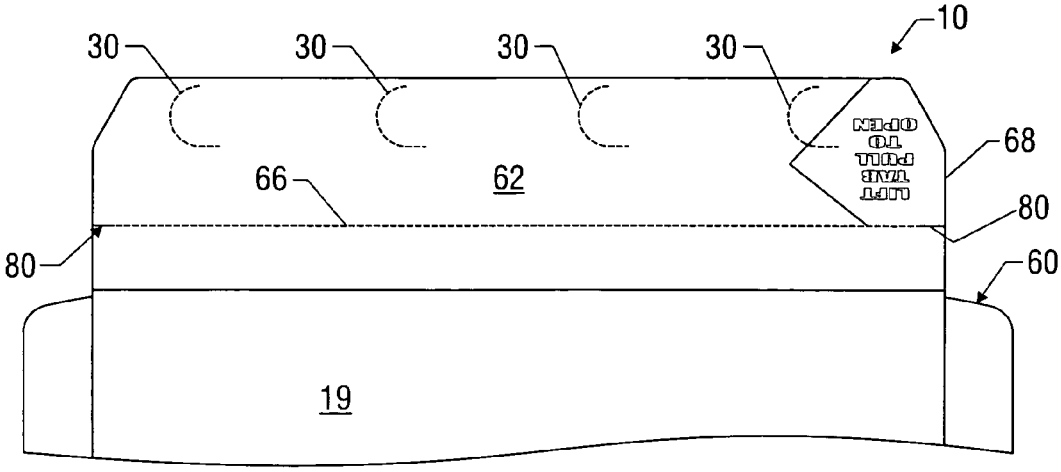
FIG. 8 is a partial rear view of an example envelope-type container including an embodiment of the present invention.

FIG. 8 shows another embodiment of the present invention in use with another example reusable envelope 60. In this example, to close or seal the envelope 60, an initial seal flap 62 is folded down along top fold line 66 and engaged to the insider surface (not shown) of a facing panel 19 by numerous adhesive spots (not shown). The top fold line 66 is perforated to enable removal of the initial seal flap 62 from the envelope 60. However, the top fold line 66 also includes at least one non-perforated section 80 to assist in preventing inadvertent, accidental or undesirable breaking of the perforated top fold line 66 during manufacture, assembly or handling of the envelope 60.

Figure 9:
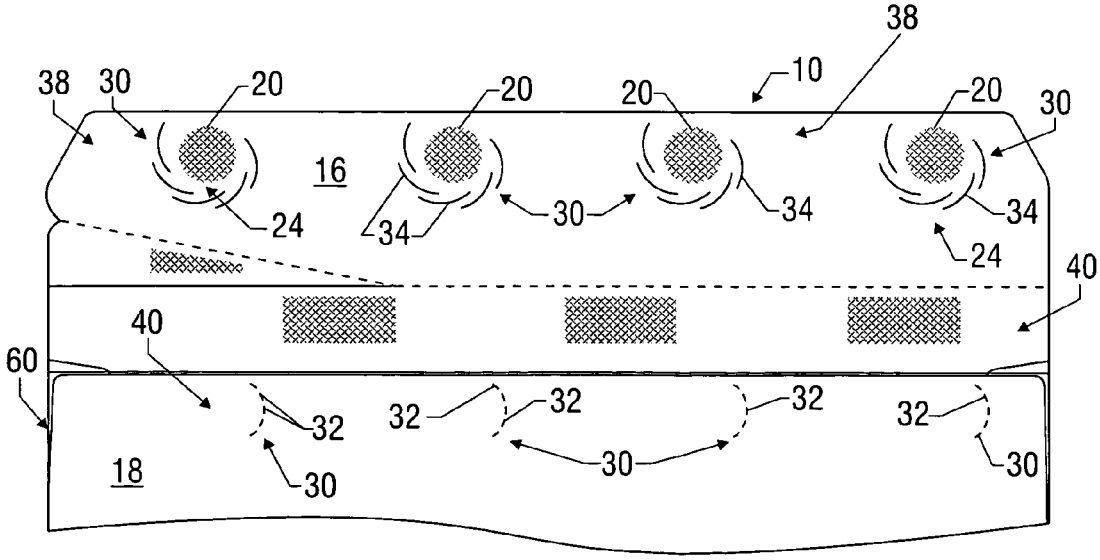
FIG. 9 is a partial front view of an example envelope-type container including an embodiment of the present invention.

In the embodiment of FIG. 9, the present invention is used on a reusable envelope 60 having first and second portions 16, 18. A group 38 of adjacent weakened areas 30 is included on the first portion 16, while a group 40 of opposing weakened areas 30 is included on the second portion 18. However, the adjacent and opposing weakened areas 30 have different configurations. The weakened areas 30 of the first group 38 include overlapping cuts 34 that generally surround three sides of the adjacent adhesive spots 20. The weakened areas 30 of the second group 40 have a single row of short cuts 32, which will lie adjacent to only one side of the adhesive spots 20 when the portions 16, 18 are connected.

Figure 10:
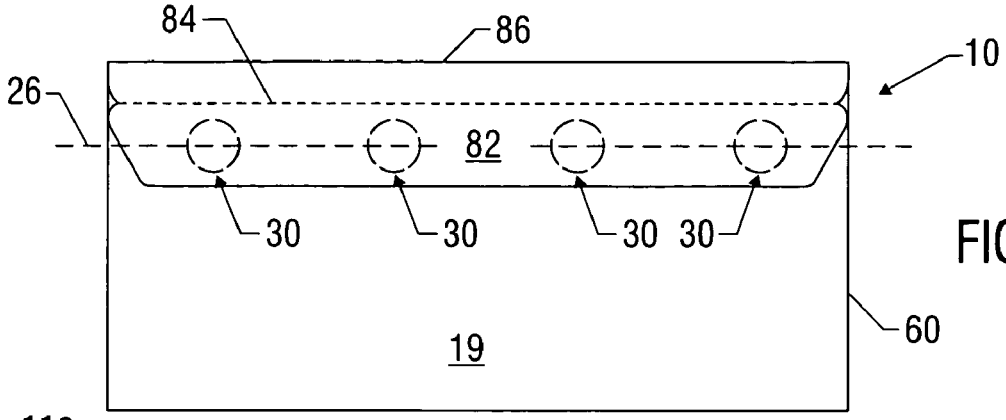
FIG. 10 is a front view of an example envelope-type container having a removable portion and including an embodiment of the present invention.

FIGS. 10–13 show various examples of envelopes in closed or sealed positions, and which include embodiments of the present invention. In FIG. 10, the envelope 60 includes a removable seal flap 82 engagable with a facing panel 19 by numerous adhesive spots (not shown) disposed along a common linear axis 26. The seal flap 82 is detachable from the envelope 60 along a perforation line 84 spaced from the top edge 86 of the envelope 60, and separable from the facing panel 19 by numerous weakened areas 30. Because the weakened areas 30 surround the corresponding adhesive spots (not shown), the seal flap 82 may be removed in any direction. Removal from left-to-right or right-to-left will allow the seal flap 82 to be generally concurrently detached from the envelope 60 and separated from the facing panel 19. Alternately, the seal flap 82 may be first separated from the facing panel 19 at the adhesive spots (such as by lifting upwardly and toward the top edge 86 of the envelope 60), and subsequently separated from the envelope 60 along the perforation line 84.

Figure 11:
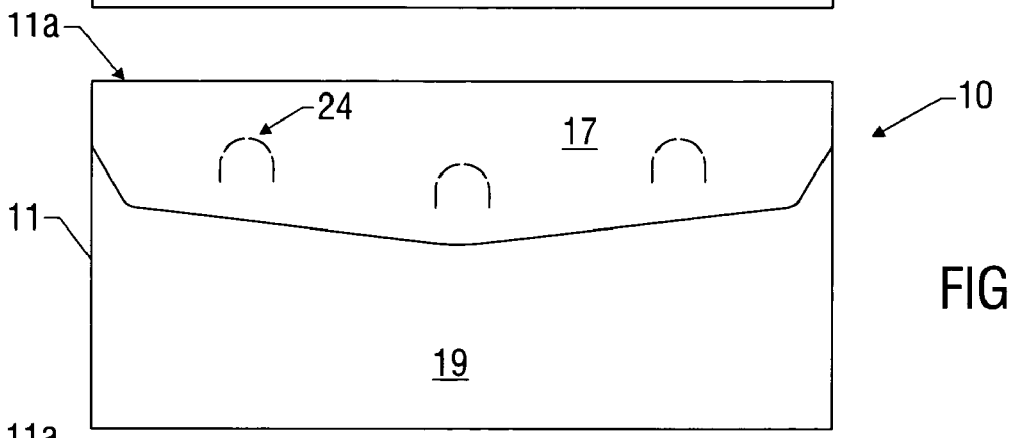
FIG. 11 is a front view of an example envelope-type container including an embodiment of the present invention.
Figure 12:
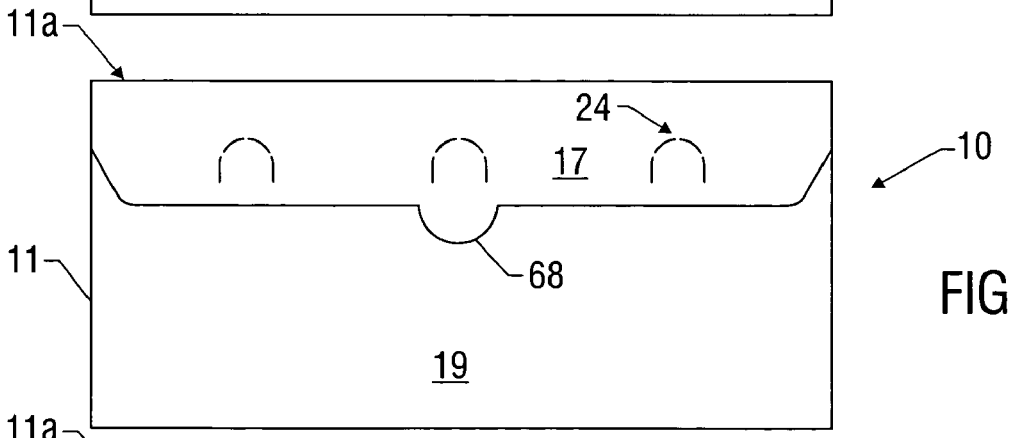
FIG. 12 is a front view of another example envelope-type container including an embodiment of the present invention.
Figure 13:
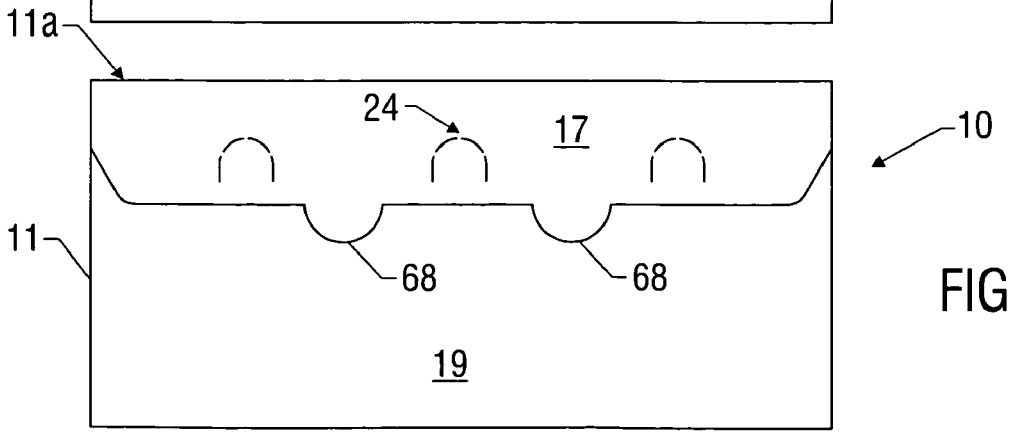
FIG. 13 is a front view of another example envelope-type container including an embodiment of the present invention.

In each of FIGS. 11–13, an envelope 11 includes numerous adhesive spots (not shown) on a seal flap 17 for connection to a facing panel 19. A weakened area 30 is located adjacent to each adhesive spot (not shown) to allow separation of the seal flap 17 from the facing panel 19 by lifting the seal flap 17 and pulling it upwardly toward the top 11*a* of the envelope 11. One or more pull tab 68 may be included to provide an easily grippable portion on the seal flap 17.

Figure 14A:
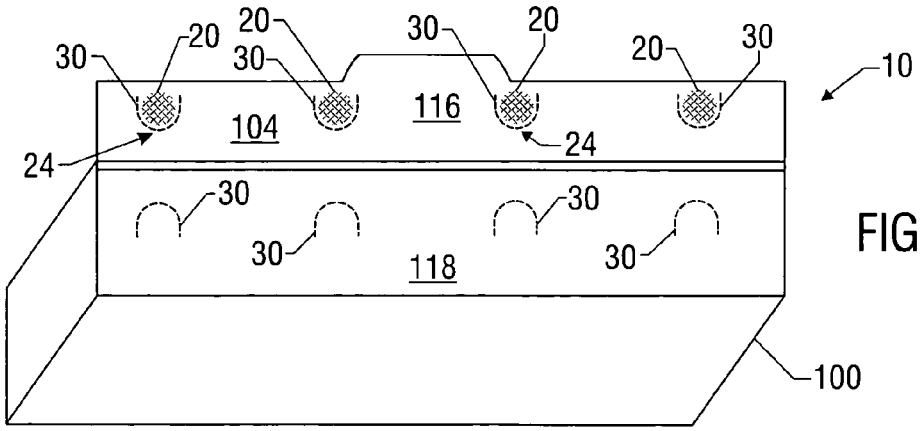
FIGS. 14A–B are partial top views of an example carton-type container including an embodiment of the present invention.
Figure 14B:
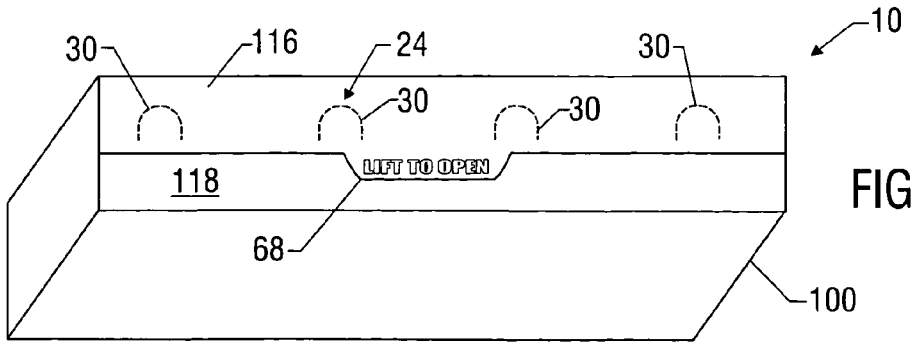

FIGS. 14A–B illustrate an example carton 100 having first and second panels 116, 118 useful for closing and opening the carton 100. In FIG. 14A, the first panel 116, shown in an open position, includes four adhesive spots 20 on its inner surface 104 and four adjacent weakened areas 30 in accordance with an embodiment of the present invention. The second panel 118 includes four opposing weakened areas 30. In FIG. 14B, the panels 116, 118 are shown in a closed position and fastened together by the adhesive spots 20, and the weakened areas 30 of the first panel 116 are aligned over the weakened areas (not shown) of the second panel 118. To open the carton 100 with separation control, the first panel 116 is preferably pulled upwardly and away from the second panel 118. In such instance, the weakened areas 30 are on the trailing side of the adhesive spots 20.

Figure 15A:
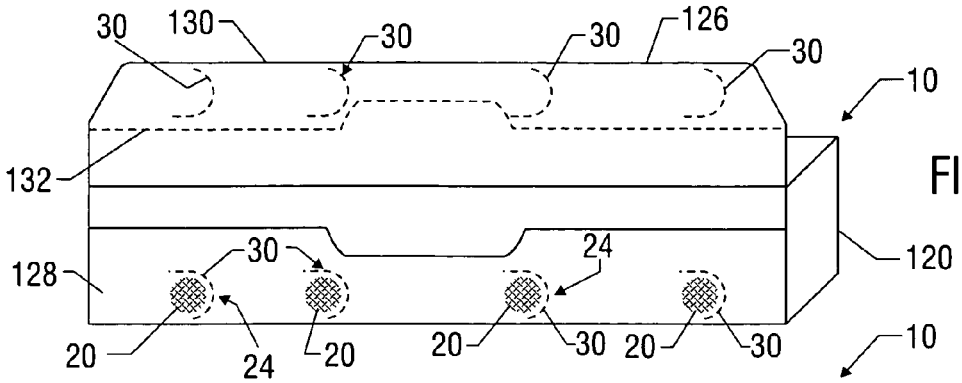
FIGS. 15A–E are partial top views of an example box-type container with a removable portion and including an embodiment of the present invention.
Figure 15B:
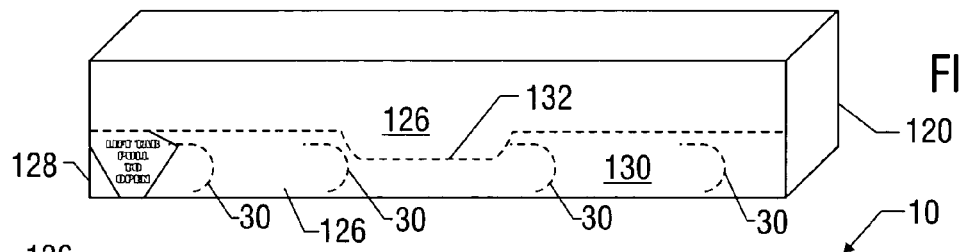
Figure 15C:
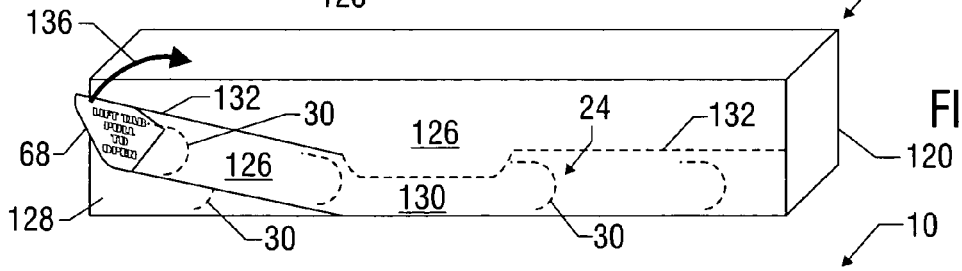
Figure 15D:
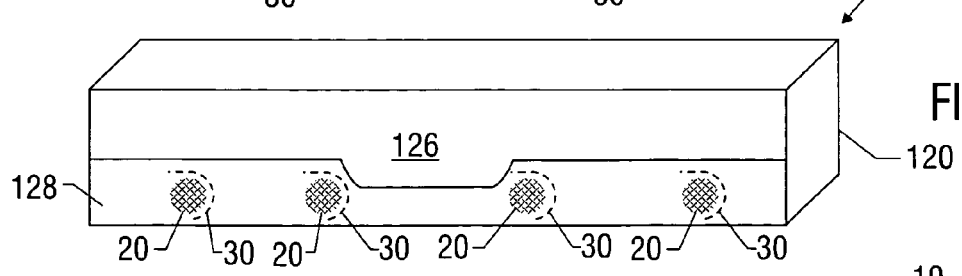
Figure 15E:
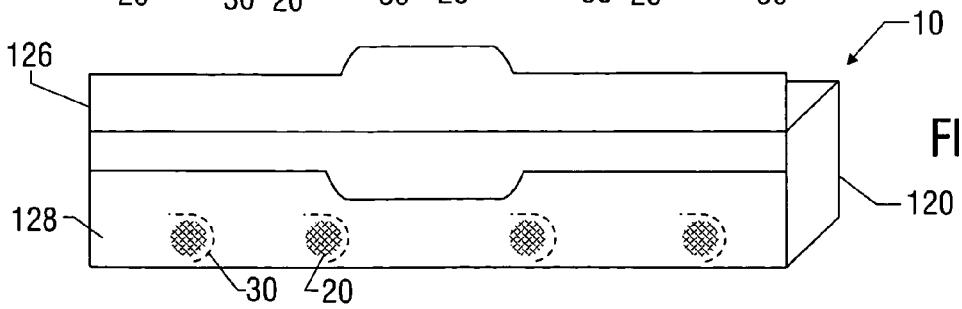

In the embodiments of FIGS. 15A–E, an example cardboard or paperboard box 120 is shown having first and second panels 126, 128 useful for closing and opening the box 120. As shown in FIG. 15A, a removable seal flap 130 having numerous opposing weakened areas 30 is connected to the first panel 126 along a perforated line 132. The second panel 128 includes numerous weakened areas 30 adjacent to numerous adhesive spots 20. In FIG. 15B, the first and second panels 126, 128 are secured together by the adhesive spots 20, and the box 120 is closed. In FIG. 15C, the seal flap 130 is shown being removed. By lifting and pulling the seal flap 130 from left to right in a single general motion, as generally indicated by arrow 136, the flap 130 is detached from the first panel 126 along the perforation line 132 and separated from the second panel 128 generally at the weakened areas 30. After the seal flap 130 is removed, as shown in FIGS. 15D–E, the first and second panels 126, 128 can be re-used for opening and closing the box 120.

Figure 16A:
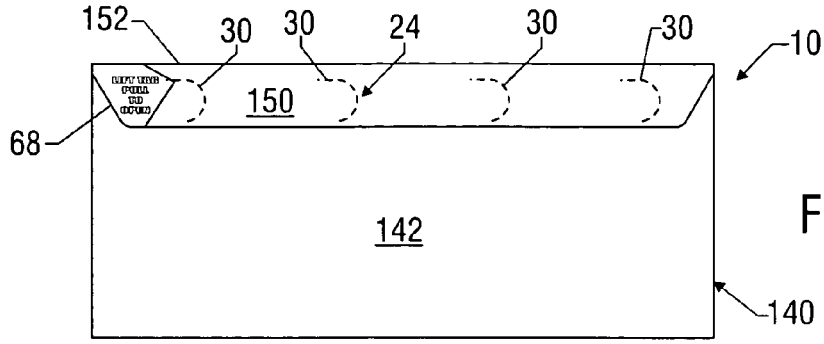
FIGS. 16A–C are front views an example form-type container with a removable portion and including an embodiment of the present invention.
Figure 16B:
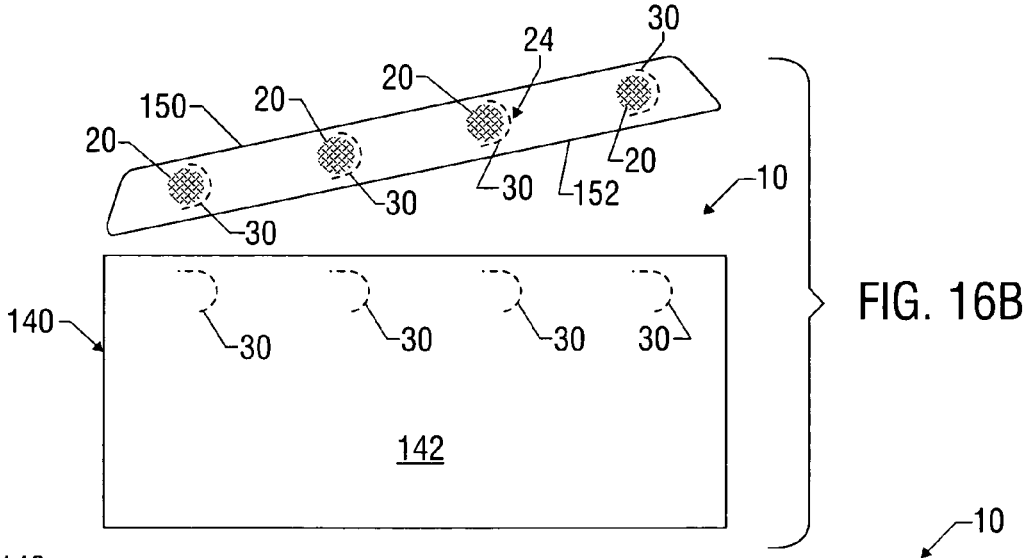
Figure 16C:
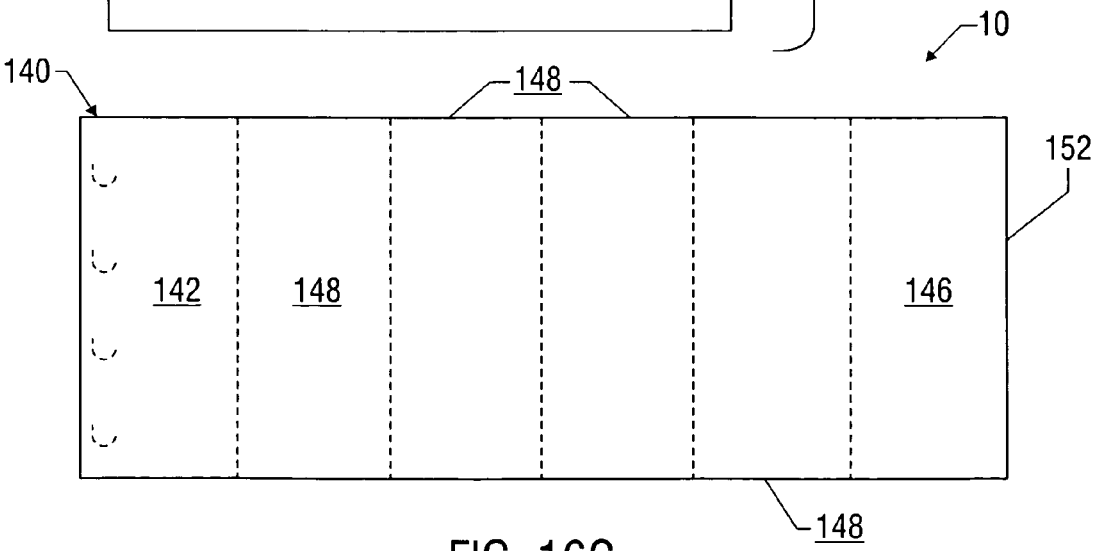

FIGS. 16A–C show an embodiment of the present invention used in connection with an example form 140. The form 140 has front and back panels 142, 146 and numerous interior panels 148 (FIG. 16C) disposed therebetween in an accordion, or foldable, configuration. A removable closure flap 150 is connected to the back panel 146 by a perforation line 152 and includes numerous adhesive spots 20 and aligned weakened areas 30. The front panel 142 includes numerous opposing weakened areas 30.

In FIG. 16A, the closure flap 150 is engaged with the front panel 142 by the adhesive spots 20, thus connecting the front and back panels. The orientation of the aligned and opposing weakened areas 30 provides for easy opening of the form 140 by pulling the closure flap 150 away from the front panel 142 from left to right. The closure flap 150 will detach from the back panel (not shown) along the perforation line 152 and from the front panel 142 proximate to the weakened areas 30. FIG. 16B shows the closure flap 150 removed from the form 140.

Figure 17A:
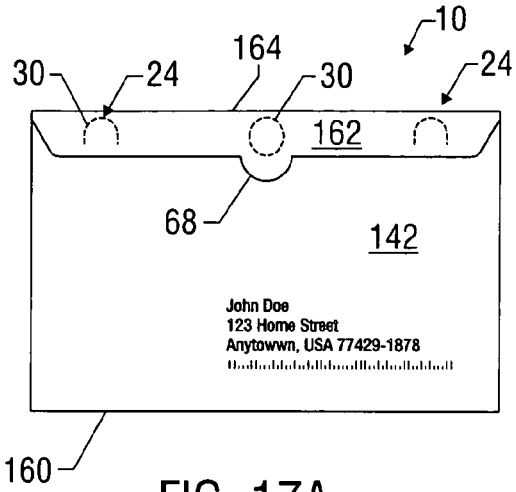
FIGS. 17A–C are front views an example brochure-type container including an embodiment of the present invention.
Figure 17B:
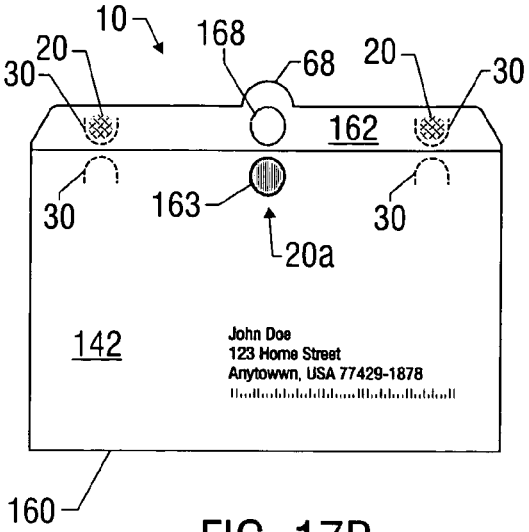
Figure 17C:
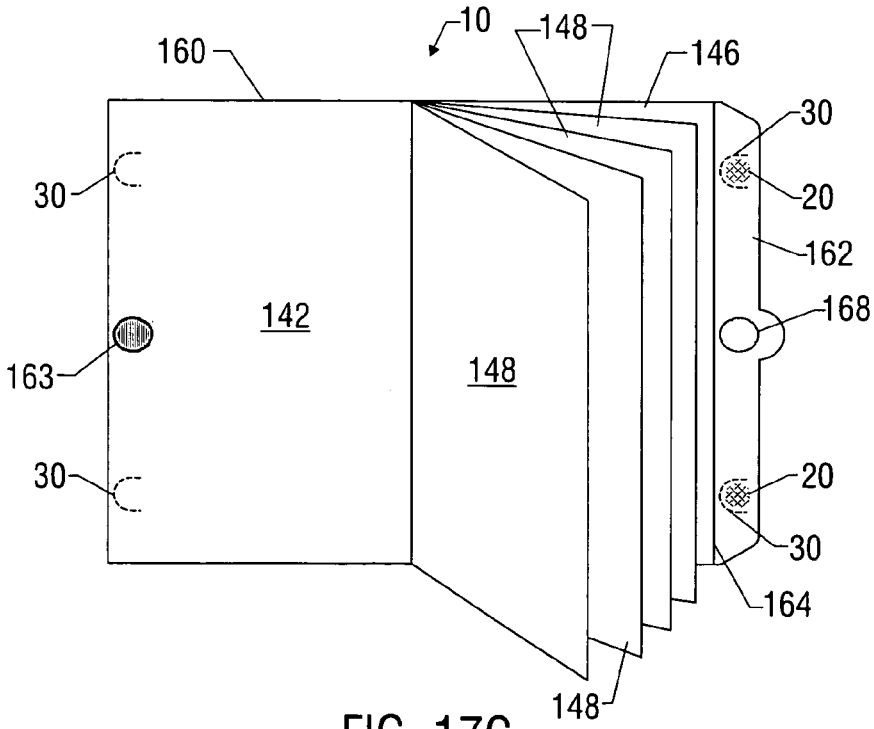

FIGS. 17A–C illustrate a mailable brochure 160 having front and back panels 142, 146 and numerous interior pages 148 disposed therebetween. A seal flap 162 extends from the back panel 146 at a fold line 164 and includes numerous adhesive spots 20 and aligned weakened areas 30. The front panel 142 includes numerous opposing weakened areas 130. In FIG. 17A, the front and back panels are connected, the seal flap 162 being engaged with the front panel 142 by the adhesive spots (not shown). The orientation of the illustrated aligned and opposing weakened areas 30 provides for easy opening of the brochure 160 by gripping the seal flap 162, such as at the tab 68, and pulling it away from the front panel 142 upwardly and in the direction of the fold line 164.

FIG. 17B shows the brochure 160 in an open position. If desired, the brochure 160 may be designed so that upon separation of the seal flap 162 and front panel 142, a portion 163 of the flap 162 tears off the flap 162 generally around the center adhesive spot 20*a*. The portion 163 of the flap 162 may remain attached to the front panel 142 (FIG. 17C) and a hole 168 left in the flap 162.

Preferred embodiments of the present invention thus offer advantages over the prior art and are well adapted to carry out one or more of the objects of the invention. It should be understood that all of the above components and any other components that may be included may have any suitable, desired size, material construction, configuration, form and quantity, as is or becomes known. The present invention is in no way limited to the components, configurations, dimensions, specific examples or other details described above or shown in the attached figures. Further, the above-described features are not limited to the details as described and shown. Yet further, each such feature can be used independent of any other feature. Moreover, the present invention does not require each of the above features and includes further capabilities, functions, methods, uses and applications, as will be apparent to a person skilled in the art based upon the description above and the appended drawings and claims.

While preferred embodiments of this invention have been shown and described, many variations, modifications and/or changes, such as in the components, details of construction and operation, arrangement of parts and/or methods of use, are possible, contemplated by the patentee, within the scope of the appended claims, and may be made and used by one of ordinary skill in the art without departing from the spirit or teachings of the invention and scope of appended claims. Thus, all matter herein set forth or shown in the accompanying drawings should thus be interpreted as illustrative and not limiting. Accordingly, the scope of the invention and the appended claims is not limited to the embodiments described and shown herein.

What is claimed is:

1. Apparatus for fastening together at least two container portions of at least one among an envelope, mailer, form and brochure and allowing the separation thereof, the apparatus including:

first and second container portions, said first and second container portions being engageable;

at least one adhesive spot disposed upon said first container portion, said at least one adhesive spot being capable of fastening together said first and second container portions; and at least one weakened area formed into said first container portion, wherein each said at least one weakened area is disposed adjacent to one of said at least one adhesive spot, further wherein each said at least one weakened area includes at least three cuts and has an overall generally arcuate shape, whereby said at least one weakened area assists in easing the separation and release of said first and second container portions by limiting the tearing of at least one among said first and second container portions proximate to said at least one adhesive spot, further whereby said at least one weakened area is sturdy enough to limit detachment of said first container portion proximate to said at least one adhesive spot from said first container portion, wherein said at least one adhesive spot is alone capable of fastening together said first and second container portions absent any other adhesive for fastening together said first and second container portions, and wherein at least one among said first and second container portions is removable from the at least one among an envelope, mailer, form and brochure along at least one perforation line.

2. Apparatus for fastening together at least two container portions of at least one among an envelope, mailer, form and brochure and allowing the separation thereof, the apparatus including:

first and second container portions, said first and second container portions being engageable;

at least one adhesive spot disposed upon said first container portion, said at least one adhesive spot being capable of fastening together said first and second container portions, wherein said at least one adhesive spot is alone capable of fastening together said first and second container portions absent any other adhesive for fastening together said first and second container portions;

at least one weakened area formed into said first container portion, wherein each said at least one weakened area is disposed adjacent to one of said at least one adhesive spot, further wherein each said at least one weakened area includes at least three cuts and has an overall generally arcuate shape, whereby said at least one weakened area assists in easing the separation and release of said first and second container portions by limiting the tearing of at least one among said first and second container portions proximate to said at least one adhesive spot, further whereby said at least one weakened area is sturdy enough to limit detachment of said first container portion proximate to said at least one adhesive spot from said first container portion; and at least one additional weakened area formed into said second container portion, whereby when said first and second container portions are connected together, one of said at least one additional weakened area is aligned with one of said at least one weakened area.

3. The apparatus of claim 2, wherein said at least one weakened area and said at least one additional weakened area ease the separation of said first and second container portions by limiting the tearing of said first and second container portions proximate to said at least one adhesive spot.

4. The apparatus of claim 3, wherein at least one among the shape and size of said at least one additional weakened area is not the same as at least one among the shape and size of said at least one weakened area.

5. Apparatus for fastening together at least two container portions of at least one among an envelope, mailer, form and brochure and allowing the separation thereof, the apparatus including;

first and second container portions, said first and second container portions being engageable:

at least one adhesive spot disposed upon said first container portion, said at least one adhesive spot being capable of fastening together said first and second container portions; and at least one weakened area formed into said first container portion, wherein each said at least one weakened area is disposed adjacent to one of said at least one adhesive spot, further wherein each said at least one weakened area includes at least three cuts and has an overall generally arcuate shape, whereby said at least one weakened area assists in easing the separation and release of said first and second container portions by limiting the tearing of at least one among said first and second container portions proximate to said at least one adhesive spot, further whereby said at least one weakened area is sturdy enough to limit detachment of said first container portion proximate to said at least one adhesive spot from said first container portion, and wherein at least one among said at least three cuts of at least one said weakened area at least partially overlaps at least one other among said at least three cuts.

6. The apparatus of claim 5, wherein at least one among said at least three cuts of each said weakened area at least partially overlaps at least one other among said at least three cuts of said respective weakened area.

7. The apparatus of claim 6, wherein at least three among said at least three cuts of each said weakened area at least partially overlaps at least one other among said at least three cuts of said respective weakened area, and wherein said at least one adhesive spot is capable of fastening together said first and second container portions in the absence of any other adhesive for fastening together said first and second container portions.

8. Apparatus for fastening together at least two container portions of at least one among an envelope, mailer, form and brochure and allowing the separation thereof, the apparatus including:

first and second container portions, said first and second container portions being engageable;

at least one adhesive spot disposed upon at least one among said first and second container portions, wherein said at least one adhesive spot is alone capable of fastening together said first and second container portions absent any other adhering mechanism for fastening together said first and second container portions, and wherein a first said adhesive spot is disposed upon said first container portion; and at least one pair of weakened areas, each said weakened area including at least two cuts, wherein a first said pair of weakened areas includes a first weakened area disposed adjacent to said first adhesive spot on said first container portion and a second weakened area disposed on said second container portion in alignment with said first weakened area, whereby when said first and second container portions are connected together, one of said first and second weakened areas overlays the other said weakened area, whereby said at least one pair of weakened areas assists in easing the separation and release of said first and second container portions by limiting the tearing of said first and second container portions proximate to said at least one adhesive spot without the detachment of a substantial part of either of said first and second container portions proximate to said at least one adhesive spot during separation thereof;

wherein the overall shape of each said weakened area is generally arcuate, and wherein when said first and second container portions are connected together, each said weakened area is disposed at least partially along the trailing side of one of said at least one adhesive spot without entirely surrounding said adhesive spot.

9. Apparatus for fastening together at least two container portions of at least one among an envelope, mailer, form and brochure and allowing the separation thereof, the apparatus including;

first and second container portions, said first and second container portions being engageable;

at least one adhesive spot disposed upon at least one among said first and second container portions, wherein said at least one adhesive spot is alone capable of fastening together said first and second container portions absent any other adhering mechanism for fastening together said first and second container portions, and wherein a first said adhesive spot is disposed upon said first container portion; and at least one pair of weakened areas, each said weakened area including at least two cuts, wherein a first said pair of weakened areas includes a first weakened area disposed adjacent to said first adhesive spot on said first container portion and a second weakened area disposed on said second container portion in alignment with said first weakened area, whereby when said first and second container portions are connected together, one of said first and second weakened areas overlays the other said weakened area, whereby said at least one pair of weakened areas assists in easing the separation and release of said first and second container portions by limiting the tearing of said first and second container portions proximate to said at least one adhesive spot without the detachment of a substantial part of either of said first and second container portions proximate to said at least one adhesive spot during separation thereof, wherein at least one among said first and second container portions is removable from the at least one among an envelope, mailer, form and brochure along at least one perforation line.

10. The apparatus of claim 9, wherein at least one among said first and second container portions is removable along said at least one perforation line after said first and second container portions are separated from one another proximate to said at least one adhesive spot.

11. The apparatus of claim 9, further including at least one tab extending from at least one among said first and second container portions, said at least one tab being useful in enabling separation of said first and second container portions.

12. The apparatus of claim 9, wherein at least one among the shape and size of said second weakened area is not the same as at least one among the shape and size of said first weakened area.

13. Apparatus for fastening together at least two container portions of at least one among an envelope, mailer, form and brochure and allowing the separation thereof, the apparatus including;

first and second container portions, said first and second container portions being engageable;

at least one adhesive spot disposed upon at least one among said first and second container portions, wherein said at least one adhesive spot is alone capable of fastening together said first and second container portions absent any other adhering mechanism for fastening together said first and second container portions, and wherein a first said adhesive spot is disposed upon said first container portion; and at least one pair of weakened areas, each said weakened area including at least two cuts, wherein a first said pair of weakened areas includes a first weakened area disposed adjacent to said first adhesive spot on said first container portion and a second weakened area disposed on said second container portion in alignment with said first weakened area, whereby when said first and second container portions are connected together, one of said first and second weakened areas overlays the other said weakened area, whereby said at least one pair of weakened areas assists in easing the separation and release of said first and second container portions by limiting the tearing of said first and second container portions proximate to said at least one adhesive spot without the detachment of a substantial part of either of said first and second container portions proximate to said at least one adhesive spot during separation thereof, wherein said at least one pair of weakened areas provides separation control when said first and second container portions are separated in at least one direction of separation.

14. Apparatus for fastening together at least two container portions of at least one among an envelope, mailer, form and brochure and allowing the separation thereof, the apparatus including;

first and second container portions, said first and second container portions being engageable;

at least one adhesive spot disposed upon at least one among said first and second container portions, wherein said at least one adhesive spot is alone capable of fastening together said first and second container portions absent any other adhering mechanism for fastening together said first and second container portions, and wherein a first said adhesive spot is disposed upon said first container portion; and at least one pair of weakened areas, each said weakened area including at least two cuts, wherein a first said pair of weakened areas includes a first weakened area disposed adjacent to said first adhesive spot on said first container portion and a second weakened area disposed on said second container portion in alignment with said first weakened area, whereby when said first and second container portions are connected together, one of said first and second weakened areas overlays the other said weakened area, whereby said at least one pair of weakened areas assists in easing the separation and release of said first and second container portions by limiting the tearing of said first and second container portions proximate to said at least one adhesive spot without the detachment of a substantial part of either of said first and second container portions proximate to said at least one adhesive spot during separation thereof, wherein said at least one pair of weakened areas provides separation control regardless of the direction of separation of said first and second container portions.

15. Apparatus for fastening together at least two container portions of at least one among an envelope, mailer, form and brochure and allowing the separation thereof, the apparatus including;

first and second container portions, said first and second container portions being engageable;

at least one adhesive spot disposed upon at least one of said first and second container portions and being capable of fastening together said first and second container portions; and at least one weakened area disposed upon at least one of said first and second container portions, each said at least one weakened areas being adjacent to one of said at least one adhesive spots when said first and second container portions are fastened together by said at least one adhesive spot, each said at least one weakened area including a plurality of cuts, wherein at least one of said plurality of cuts of at least one of said weakened areas at least partially overlaps at least one other among said plurality of cuts of said weakened area, whereby said at least one weakened area assists in easing the separation of said first and second container portions by limiting the tearing of at least one among said first and second container portions proximate to said at least one adhesive spot without detachment of a substantial part of either of said first and second container portions proximate to said at least one adhesive spot during separation of said first and second container portions, wherein at least three among each said plurality of cuts of each said weakened area at least partially overlaps at least one other of said plurality of cuts.

16. Apparatus for fastening together at least two container portions of at least one among an envelope, mailer, form and brochure and allowing the separation thereof, the apparatus including;

first and second container portions, said first and second container portions being engageable;

at least one adhesive spot disposed upon at least one of said first and second container portions and being capable of fastening together said first and second container portions;

at least one weakened area disposed upon at least one of said first and second container portions, each said at least one weakened areas being adjacent to one of said at least one adhesive spots when said first and second container portions are fastened together by said at least one adhesive spot, each said at least one weakened area including a plurality of cuts, wherein at least three among each said plurality of cuts of each said weakened area at least partially overlaps at least one other of said plurality of cuts of said weakened area, whereby said at least one weakened area assists in easing the separation of said first and second container portions by limiting the tearing of at least one among said first and second container portions proximate to said at least one adhesive spot without detachment of a substantial part of either of said first and second container portions proximate to said at least one adhesive spot during separation of said first and second container portions;

a plurality of connectors, one said connector extending between each adjacent said cut of each said plurality of cuts of each said weakened area, wherein each said connector does not face said adjacent adhesive spot; and at least three said adhesive spots and at least three said weakened areas, wherein said at least three adhesive spots are capable of fastening together said first and second container portions in the absence of any other adhesive for fastening together said first and second container portions.

17. Apparatus for fastening together at least two container portions of at least one among an envelope, mailer, form and brochure and allowing the separation thereof, the apparatus including;

first and second container portions, said first and second container portions being engageable;

at least one adhesive spot disposed upon at least one of said first and second container portions and being capable of fastening together said first and second container portions; and at least one weakened area disposed upon at least one of said first and second container portions, each said at least one weakened areas being adjacent to one of said at least one adhesive spots when said first and second container portions are fastened together by said at least one adhesive spot, each said at least one weakened area including a plurality of cuts, wherein at least one of said plurality of cuts of at least one of said weakened areas at least partially overlaps at least one other among said plurality of cuts of said weakened area, whereby said at least one weakened area assists in easing the separation of said first and second container portions by limiting the tearing of at least one among said first and second container portions proximate to said at least one adhesive spot without detachment of a substantial part of either of said first and second container portions proximate to said at least one adhesive spot during separation of said first and second container portions, wherein at least one said weakened area has an overall generally U shape to provide separation control of said first and second container portions in any among up to three directions of separation.

18. Apparatus for fastening together at least two container portions of at least one among an envelope, mailer, form and brochure and allowing the separation thereof, the apparatus including;

first and second container portions, said first and second container portions being engageable;

at least one adhesive spot disposed upon, at least one of said first and second container portions and being capable of fastening together said first and second container portions; and at least one weakened area disposed upon at least one of said first and second container portions, each said at least one weakened areas being adjacent to one of said at least one adhesive spots when said first and second container portions are fastened together by said at least one adhesive spot, each said at least one weakened area including a plurality of cuts, wherein at least one of said plurality of cuts of at least one of said weakened areas at least partially overlaps at least one other among said plurality of cuts of said weakened area, whereby said at least one weakened area assists in easing the separation of said first and second container portions by limiting the tearing of at least one among said first and second container portions proximate to said at least one adhesive spot without detachment of a substantial part of either of said first and second container portions proximate to said at least one adhesive spot during separation of said first and second container portions, wherein at least one among said first and second container portions is removable along at least one perforation line.

19. The apparatus of claim 18, wherein at least one among said first and second container portions is substantially simultaneously separable from the other of said first and second container portions proximate to said at least one adhesive spot and removable along said at least one perforation line.

20. The apparatus of claim 18, wherein at least one among said first and second container portions is removable along said at least one perforation line subsequent to separation from the other of said first and second container portions proximate to said at least one adhesive spot.

21. Apparatus for sealing together at least two container portions of at least one container and allowing the separation thereof, the apparatus including;

first and second container portions, said first and second container, portions being engageable, wherein at least one among said first and second container portions is removable from the at least one container and the at least one container may thereafter be resealed;

at least one adhesive spot disposed upon at least one among said first and second container portions and capable of fastening together said first and second container portions; and at least one weakened area disposed adjacent to one of said at least one adhesive spot, whereby said at least one weakened area assists in easing the separation of said first and second container portions by limiting the ply separation of at least one among said first and second container portions proximate to said at least one adhesive spot without detachment of a substantial part of either of said first and second container portions proximate to said at least one adhesive spot during separation of said first and second container portions;

wherein at least one among said first and second container portions is removable from the at least one container along at least one perforation line, wherein the at least one container is an envelope and said at least one perforation line extends at least partially along the top edge of the envelope.

22. The apparatus of claim 21, wherein the at least one container is an envelope and said at least one perforation line is at least partially angularly oriented.

* * * * *